US005506569A

United States Patent [19]

Rowlette

[11] Patent Number: 5,506,569

[45] Date of Patent: Apr. 9, 1996

[54] SELF-DIAGNOSTIC FLAME RECTIFICATION SENSING CIRCUIT AND METHOD THEREFOR

[75] Inventor: Mitchell R. Rowlette, Berea, Ky.

[73] Assignee: Texas Instruments Incorporated, Dallas, Tex.

[21] Appl. No.: 251,816

[22] Filed: May 31, 1994

[51] Int. Cl.[6] ..... F23N 5/00

[52] U.S. Cl. ..... 340/577; 340/579; 431/24; 431/25; 110/185; 110/190

[58] Field of Search ..... 340/577, 579; 431/24, 25, 256; 136/219; 110/185, 190

[56] References Cited

U.S. PATENT DOCUMENTS

| | | | |
|---|---|---|---|
| 4,082,493 | 4/1978 | Dahlgren | 431/25 |
| 4,319,873 | 3/1982 | Michaud | 431/24 |
| 4,382,770 | 5/1983 | Pinckaers | 431/24 |
| 4,413,303 | 11/1983 | Cheary | 431/25 |
| 4,457,701 | 7/1984 | Gaiffier | 431/24 |
| 4,461,615 | 7/1984 | Inoue | 431/25 |
| 4,518,345 | 5/1985 | Mueller | 431/24 |
| 4,616,138 | 10/1986 | Yuchi | 431/24 |
| 4,923,117 | 5/1990 | Adams | 431/24 |
| 4,955,806 | 9/1990 | Grunden | 431/24 |
| 5,074,780 | 12/1991 | Erdman | 431/24 |
| 5,076,780 | 12/1991 | Erdman | 431/24 |
| 5,236,328 | 8/1993 | Thie | 431/24 |
| 5,256,057 | 11/1993 | Grow | 431/25 |
| 5,272,427 | 12/1993 | Nold et al. . | |

*Primary Examiner*—Brent A. Swarthout
*Assistant Examiner*—Albert K. Wong
*Attorney, Agent, or Firm*—Russell E. Baumann; Richard L. Donaldson; René E. Grossman

[57] ABSTRACT

An electric control is shown for gas furnaces which controls fan motors and ignition controls based on inputs from a room thermostat (32), a high limit control and an ignition control (14) including a gas valve. A flame sense circuit (42, 42') is coupled to a microprocessor (U2) and includes a flameprobe (P1) energized by line power through a capacitor (C3) via a quick connect (QC31). A capacitor (C4) is charged by a 5 volt DC source through resistor (R12) and inputted to an inverter (U3, S2) which provides a low signal to the microprocessor when no flame is present. When a flame is present the capacitor (C4) discharges through the flame causing the inverter to change state providing a high to the microprocessor indicating that a flame is present. A diagnostic network comprising a low leakage diode (CR10) and serially connected resistor (R11) is coupled between the microprocessor (pin 8) and the input of the inverter (U3) so that the operation of the flame sense circuit can be tested. In an alternate embodiment CMOS switches (S1, S2) are used both to verify that the flame sense circuit is properly wired and to simulate a no-flame condition.

10 Claims, 5 Drawing Sheets

SELF-DIAGNOSTIC FLAME RECTIFICATION SENSING CIRCUIT AND METHOD THEREFOR

BACKGROUND OF THE INVENTION

This invention relates generally to gas furnace controls and more specifically to the sensing of the presence or absence of a flame in a furnace.

Use of the phenomena of so-called flame rectification to sense the presence or absence of a flame is conventional in gas furnace controls technology. Typically, 120 volt AC power is coupled to a flameprobe through a first capacitor. When there is no flame present a second capacitor coupled to the probe is charged to a selected value, e.g., 5 volts DC, through a resistor connected to a DC voltage source. A change of state device, such as an inverter, has an output connected to a microprocessor and an input connected to the second capacitor. When no flame is present the second capacitor maintains the voltage at the input of the inverter above its threshold so that the output of the inverter is low thereby providing an indication to the microprocessor that there is no flame. When a flame is present, the second capacitor discharges to ground through the flame which acts as a poor diode connected in series with a resistor. When the second capacitor discharges to a level below the threshold, the inverter changes state with its output going high thereby providing an indication to the microprocessor that a flame is present.

A problem exists with this approach however, in view of the low level of current flow. If the inverter or the second capacitor develop too much leakage current to ground an indication of the presence of a flame can occur even at times when, in fact, no flame is present. This can happen because of age, static damage, faulty components or the like. During an ignition sequence when the microprocessor is, in effect, expecting a flame this could result in open gas valves if the circuit failed and indicated the presence of the flame when, in fact, no flame was present. This problem is conventionally dealt with by providing a dual or redundant sensing circuit. In the event that the same signal is not provided by both the primary and the redundant sensing circuit then the logic in the microprocessor maintains the valves in the closed condition. In using the redundant sensing circuit approach an assumption is made that both circuits will not fail at the same time. However, in addition to adding to the cost of the device a problem exists in that if the cause of failure is due to an external event then both circuits could fail simultaneously.

SUMMARY OF THE INVENTION

It is an object of the invention to provide a flame sensing circuit for a gas furnace control which has improved reliability. Another object of the invention is the provision of diagnostic apparatus and a method for verifying the efficacy and proper functioning of a flame sensing circuit. Still another object is the provision of a diagnostic network for a flame sensing circuit which is inexpensive yet reliable.

Briefly, in accordance with the invention, a diagnostic network is added to the flame sensing circuit comprising a signal line connected to an output port of the gas furnace controls microprocessor, the signal line being connected through a low leakage diode and a serially connected resistor to the input side of the change of state device. After detecting the presence of a flame, for example, during an ignition cycle, a no-flame condition is simulated by setting the signal line at 5 volts DC and, in effect, comparing the time actually expended with a standard for the change of state device to change state as the second capacitor charges. Then the 5 volts DC is removed from the signal line and time expended for the change of state device to again change state as the second capacitor is discharged, is compared to a standard. The first time is reflective of the amount of leakage to ground at the change of state device and at the second capacitor and in general provides a check on the flame sensing circuit as a whole. The second time period is reflective of the quality of the flame. The microprocessor, on a routine basis, goes through this sequence to ensure that the flame sensing circuit is functioning properly.

In an alternate embodiment, CMOS switches are used both to verify that the flame sense circuit is properly wired and to simulate a no-flame condition.

Additional objects and advantageous of the invention will be set forth in part in the description which follows and in part will be obvious from the description. The objects and advantages of the invention may be realized and attained by means of the instrumentalities, combinations and methods particularly pointed out in the appended claims.

BRIEF DESCRIPTION OF THE DRAWINGS

The accompanying drawings, which are incorporated in and constitute a part of the specification, illustrate preferred embodiments of the invention and, together with the description, serve to explain the objects, advantages and principles of the invention. In the drawings.

DETAILED DESCRIPTION OF THE PREFERRED EMBODIMENTS

Figure 1A:
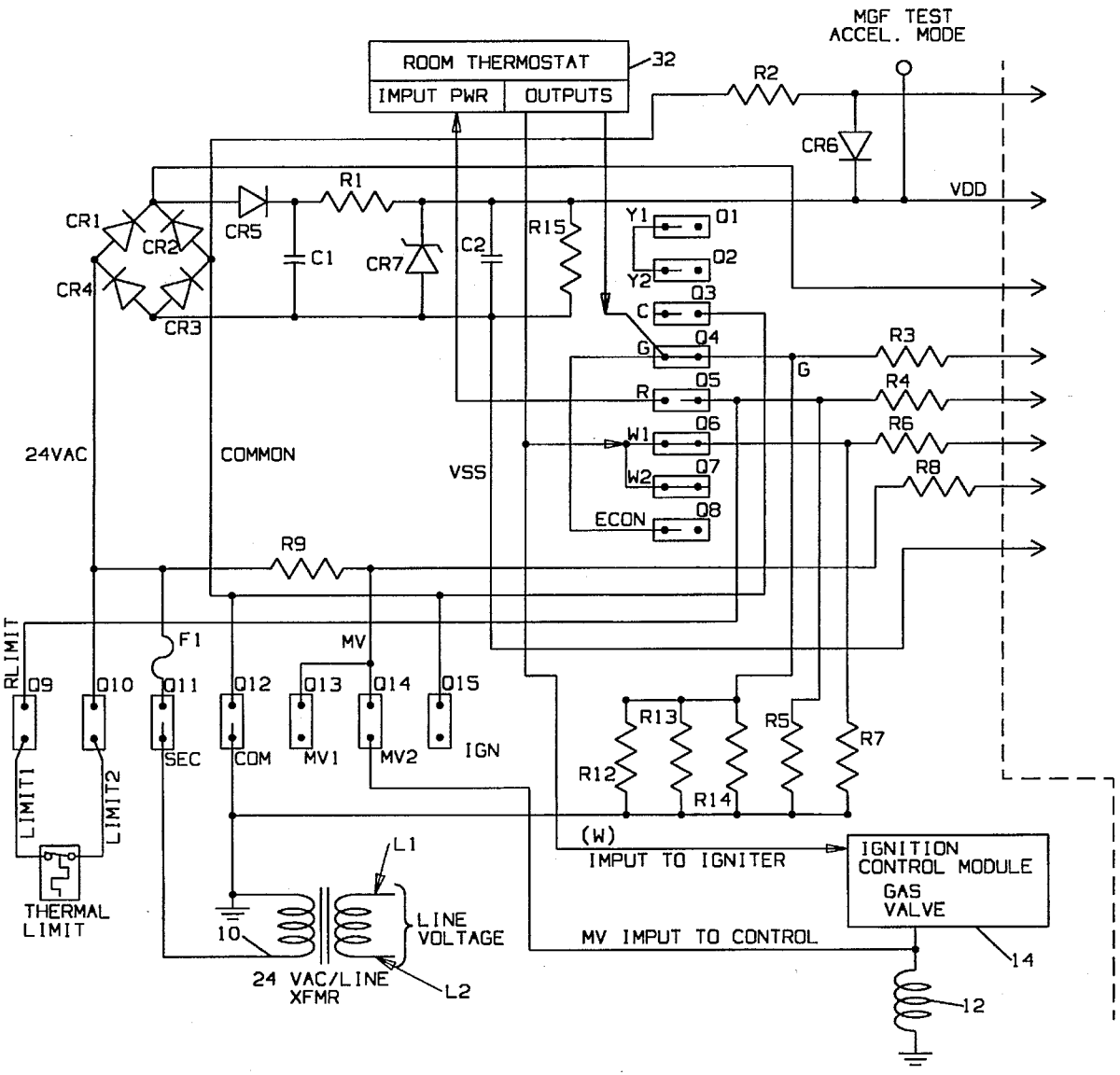
FIGS. 1*a* and 1*b* taken together is a schematic view of a gas furnace control system made in accordance with the invention.
Figure 1B:
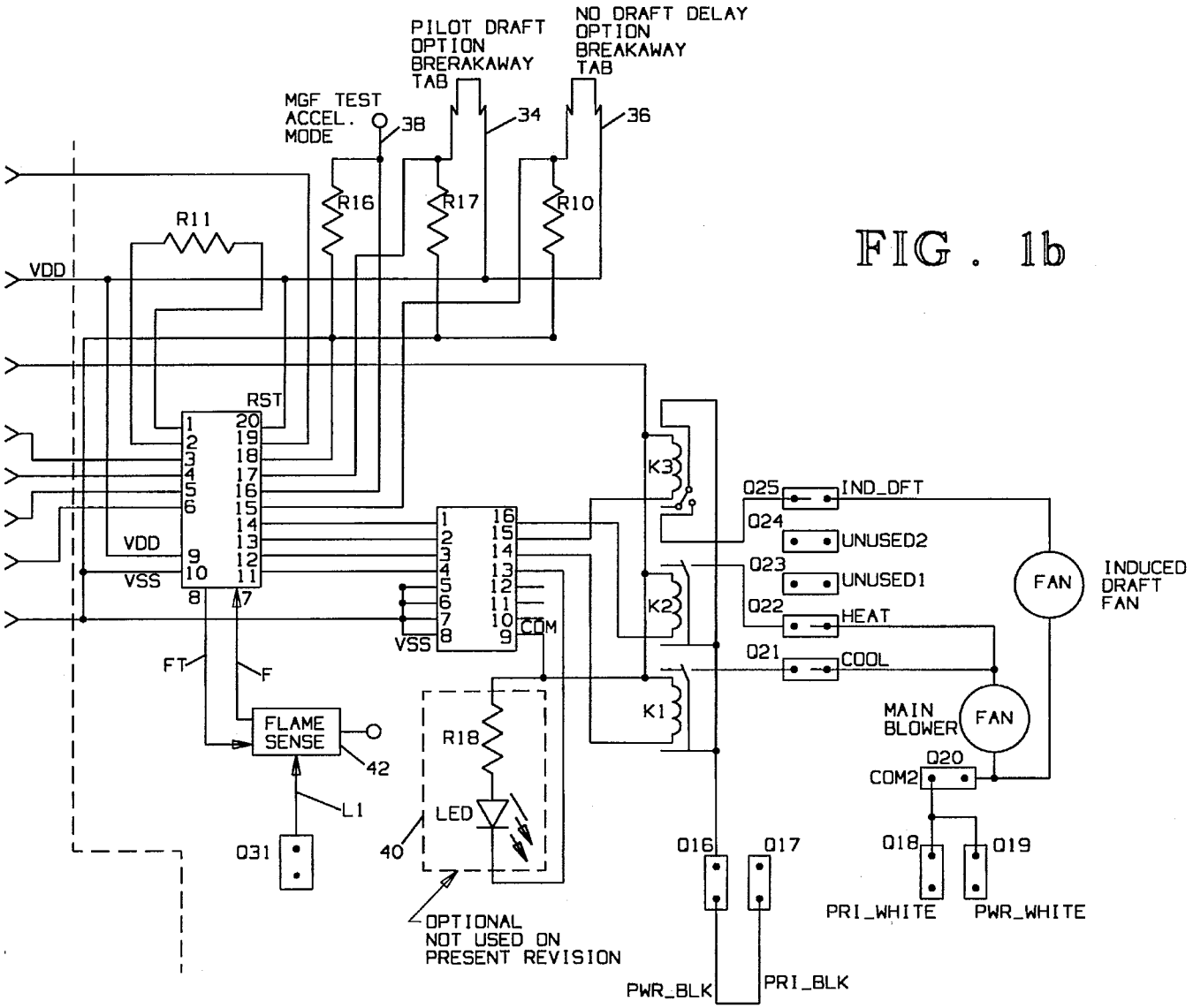

With reference to FIGS. 1*a* and 1*b* a schematic representation is shown of a control circuit and other components of a gas furnace system with which the control system is used. Transformer 10, providing 24 volts AC from line voltage, is connected at the 24 VAC output side to connector Q11 and then through a 5 amp fuse F1 to a full wave bridge comprising diodes CR1, CR2, CR3 and CR4. The transformer common is connected to the bridge through connector Q12. The bridge provides full wave rectified 24 VAC power to drive relays K1, K2 and K3 to be discussed below. Zener diode CR7 suppresses back EMF. Capacitor C2, resistor R15 and capacitor C1, resistor R1 provide 5 volts DC on line VDD for the power supply of microprocessor U2 to be discussed below.

There are several low voltage AC input terminals labeled Y1, Y2, C, G, R, W1, W2 and ECON. Terminals Y1 and Y2 are not used in the illustrated embodiment. Terminal C is connected to the transformer common, terminal G is coupled to an output of thermostat 32 and to input port 3 of microprocessor U2 through a resistor R3 and is connected to common through pull down resistors R12, R13, R14 connected in parallel to provide a selected equivalent resistance. Terminal G is also connected to the terminal ECON. A signal on the G terminal results in energizing the manual fan as well as providing a cool request. Terminal W is coupled to an output of room thermostat 32 and to the ignition control module 14, the other side of which is connected to common through the gas valve solenoid coil 12 and to connector Q14. Terminal W1 interconnected with terminal W2, is connected to input port 5 of microprocessor U2 through limiting resistor R6 and to common through pull down resistor R7. Connector Q14 is connected to the 24 VAC output of transformer 10 through pull up resistor R9 and to input port 6 of microprocessor U2 through limiting resistor. The main valve itself serves as a pull down resistor. Pull up resistor R9 serves as a safety feature. That is, if for any reason, the gas valve is not correctly wired to the control circuit since there is no separate pull down resistor to common, pull up resistor R9 will always provide a high input thereby turning the induced draft fan on.

Another input to microprocessor U2 is IRQ port 19 which is a common input received through resistor R2. Clamping diode CR6, connected between port 19 and the 5 volt supply VDD, drops the input at 5 volts.

Microprocessor U2 has two additional, optional inputs provided by breakaway tabs 34, 36. Input port 15 is connected to the 5 volt supply VDD through breakaway tab 36 and to DC ground or common VSS through resistor R10. Normally the system provides a selected period of time that the draft fan is maintained in the energized condition after its energization signal has been removed. This occurs when port 15 is pulled high by its connection with the 5 volt supply VDD. However, if tab 36 is broken off, resistor R10 will pull port 15 to ground providing a low. Then the draft fan is turned off at the same time its energization signal has been removed.

Similarly, port 7 is connected to the 5 volt supply VDD through tab 34 and to ground VSS through resistor R17. Tab 34 provides a pilot draft option.

Reference numeral 38 indicates a wiring point which is used for testing the control. That is, by placing a 5 volt DC input at point 38 the control is placed in a test mode, in effect shortening all the normal time delays. Point 38 is connected to port 16 of microprocessor U2 and ground through resistor R16. DC ground VSS is also connected to ports 10 and 7 of microprocessor U2.

Output ports 11–14 are connected to relay driver integrated circuit U1 at pins 4, 3, 2 and 1, respectively. Relay driver U1 comprises a transistor network which, in effect, switches on relays K1, K2, and K3 when the base of the transistors receive an input signal from microprocessor U2. Output pin 15 of relay driver U1 is connected to the coil of relay K3 which has a common contact connected to power connectors Q16, Q17 and a normally open contact connected to connector Q25.

Power connectors Q16, Q17 are connected to switching mechanisms in respective relays K1, K2 and K3. Energization of the relay coil of relay K1 through output port 14 will cause the switch to connect power to terminal Q21, the cool speed of the fan motor. Energization of the relay coil of relay K2 through output port 16 will cause the switch to connect power to terminal Q22, the heat speed of the fan motor. Energization of the relay coil of relay K3 through output port 15 will cause the switch to connect power to terminal Q25, the induced draft fan motor.

An optional feature is shown at the dashed line box identified by numeral 40 comprising resistor R18 serially connected to LED between pin 13 of relay drive U1 and common, pin 9. This feature provides a flashing or continuous LED light based on the state of the inputs.

Resistor R11 is connected to pins 1 and 2 of microprocessor U2 to provide a selected rate of oscillation for the internal clock.

The control board is provided with connectors Q9 and Q10 to connect a high limit switch. The high limit switch is normally closed but adapted to open upon an over temperature condition. An economizer function is tied to terminal G. This can be used as an output in a system having an economizer, i.e., an option which, for example, opens a duct to outside fresh air when the manual fan is on.

The above described apparatus for controlling the energization of a main blower fan motor and an induced draft fan motor based on low voltage AC input signals is shown and described in greater detail in U.S. Pat. No. 5,272,427, assigned to the assignee of the present invention, the subject matter of which is incorporated herein by this reference.

Figure 2:
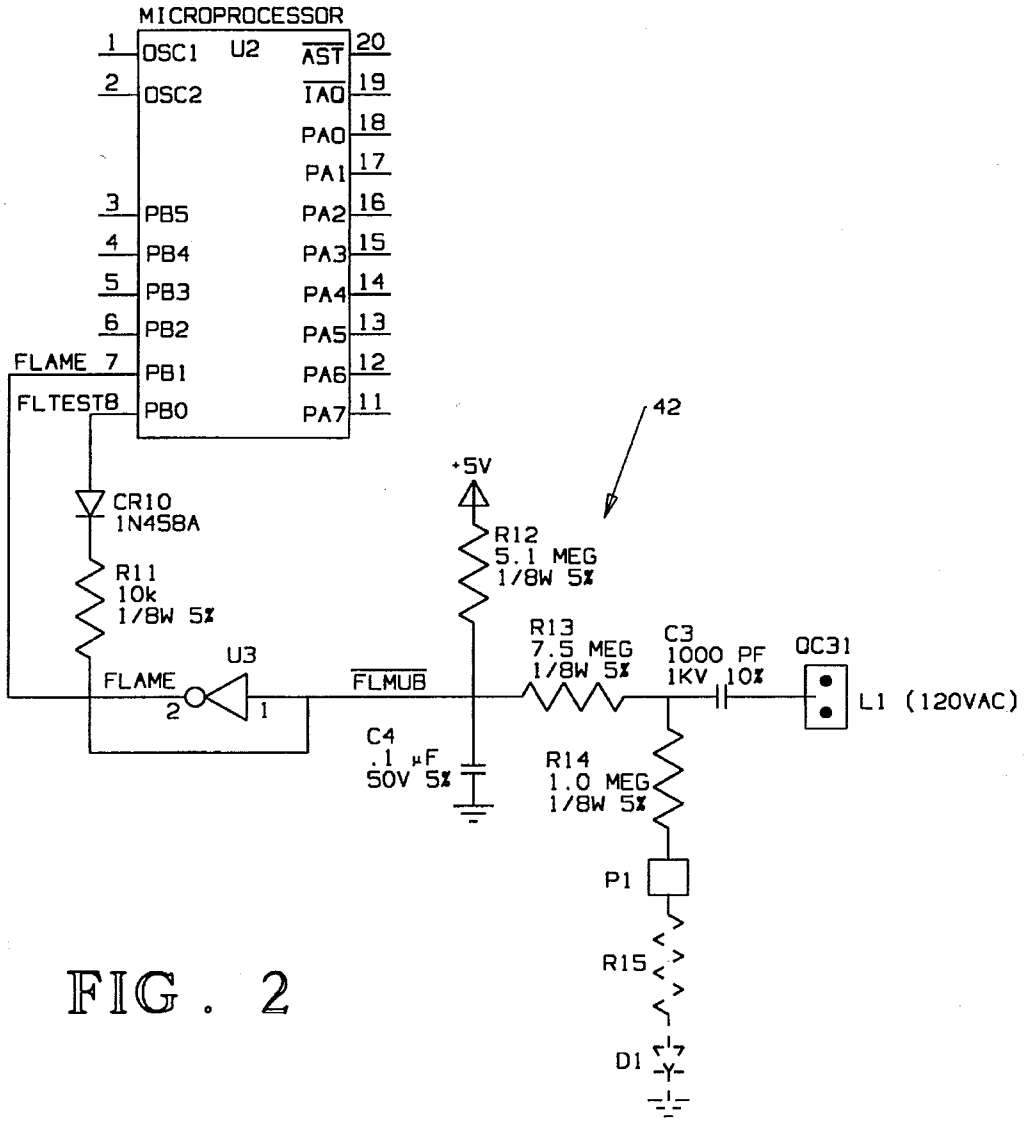
FIG. 2 is a schematic view of the flame sense circuit portion of FIGS. 1*a* and 1*b* and including the diagnostic network portion made in accordance with the invention.

According to the present invention, a flame sense circuit 42 is coupled to microprocessor U2 in order to sense the presence and absence of a flame. As seen in FIG. 2, flame sense circuit 42 comprises a flameprobe P1 adapted to be mounted in the furnace in a conventional manner in a location where combustion occurs. AC line power L1 (120 VAC) is provided for the probe via quick connect Q31 through a first capacitor C3 and an isolation resistor R14. Resistor R14 avoids potential shorting of the flameprobe with the furnace which is connected to ground. A second capacitor C4 is connected on one side to serially connected flameprobe P1 and resistor R14 through a resistor R13 and on the other side to ground. Capacitor C4 is also connected to the input pin 1 of a change of state device, inverter U3 and, through resistor R12 to a positive 5 volt DC source, i.e., VDD. The output pin 2 of inverter U3, labeled FLAME, is connected to input pin 7 (PB1) of microprocessor U2.

Pin 8 (PB0) of microprocessor U2 is connected to the input of inverter U3 through a low leakage diode CR10 and a serially connected resistor R11. The value of resistor R11 is selected to provide a suitable time period for charging capacitor C4 during the diagnostic test and is significantly less than the value of resistor R12.

Under normal circumstances, with no flame present, capacitor C4 will be charged essentially to 5 volts through resistor R12 and the output of inverter U3 will be low, i.e., 0 volts, signifying that there is no flame. When a flame is present, which effectively acts as a poor diode and serially connected resistor, as indicated by the dashed lines D1, R15, capacitor C4 discharges through the flame. When the charge on capacitor C4 reaches the threshold point of inverter U3 its output changes to high thereby providing an indication to the microprocessor that a flame is present.

The flame has an effective resistance on the order of 10 meg ohms and with resistor R13 being 7.5 meg ohms the resulting current flow is very small. If inverter U3 or capacitor C4 develops too much leakage to ground then input pin 1 of inverter U3 can be pulled down below the threshold even when no flame is present thereby giving a false indication of a flame.

In accordance with the invention, once the gas furnace control enters the ignition cycle and the presence of the flame is detected, capacitor C4 being discharged, as described above, the circuit is tested by setting port PB0, pin 8, at 5 volts. This provides a path to charge capacitor C4 through resistor R11 and diode CR10. The amount of time taken for the capacitor to charge, i.e., until inverter U3 switches low, is compared to a standard. This period is reflective of the leakage to ground from pin 1 of inverter U3 and capacitor C4. Then the flame test signal at pin 8 is turned off interrupting the charge path to capacitor C4 so that the capacitor begins to discharge, assuming there is a flame present. The time taken for this to occur, i.e., for inverter U3 to again change state, is compared to a standard and is reflective of the quality of the flame.

If the inverter changes state within a selected period of time following the setting of pin 8 at 5 volts then the circuit is operating as intended. In other words this time period is reflective of how much current is being leaked to ground rather than charging capacitor C4. In order to optimize the effectiveness of the diagnostic network preferably an ultra low leakage diode is selected for diode CR10, such as a 1N458A device which has leakage in the order of 1 nanoamp at 200 volts reversed. As stated above, the value of resistor R11 is selected to provide a suitable charging time for capacitor C4. Thus the amount of time actually taken for charging the capacitor is indicative of whether or not there is a leakage problem. Further, proper functioning of inverter U3 and input to the microprocessor can be confirmed by the test. The second period of time reflects the quality of the flame, i.e., how long it takes to discharge through the flame, the only path through which leakage occurs since the absence of other leakage paths has been confirmed by the first time period.

Figure 3:
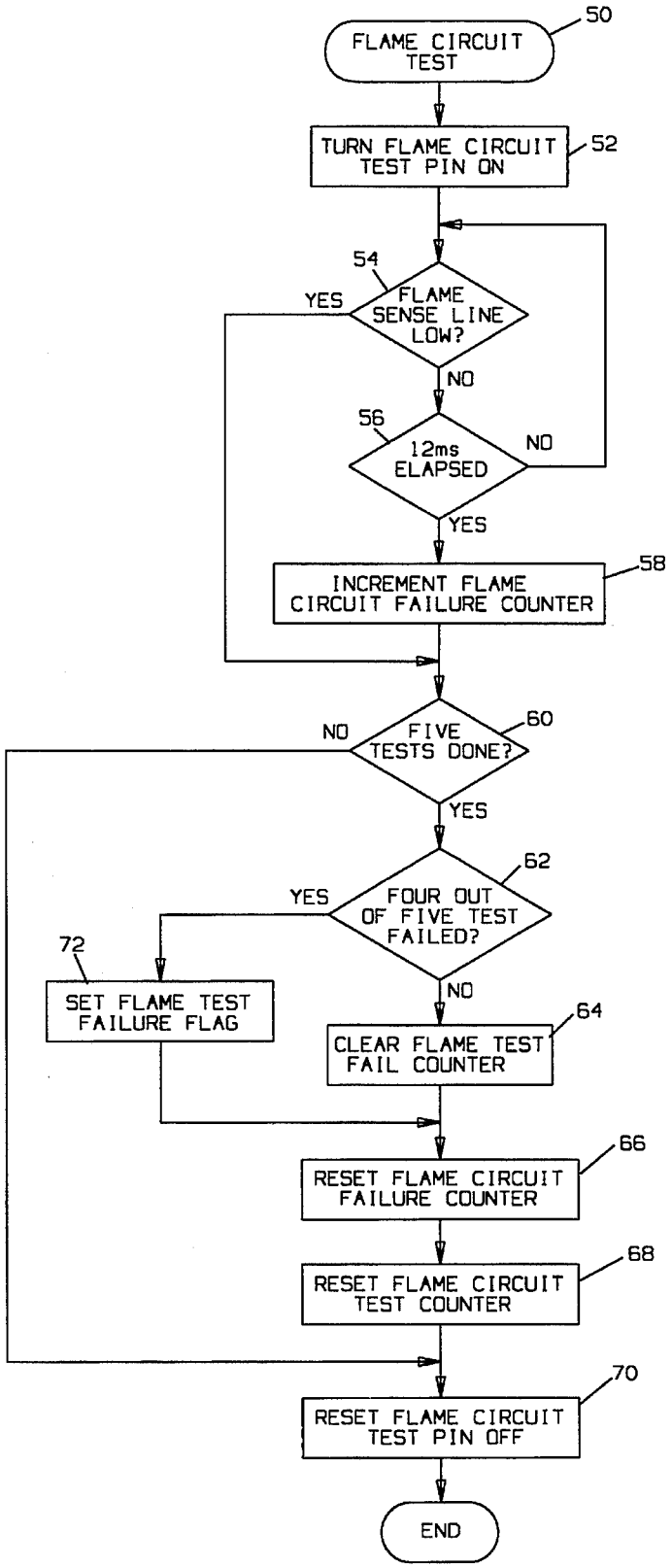
FIG. 3 is a flow chart of a software sub-routine which provides the test sequence.

More specifically, with regard to the flame circuit test, during selected times when the input signal at pin 7 indicates that a flame is present a flame circuit test is conducted as depicted in the flow chart of FIG. 3. The test 50 is initiated by turning on the flame circuit test pin 8, step 52, in effect simulating the absence of a flame by driving the input of inverter U3 high causing its output to turn low. Decision block 54 then determines if the flame sense line is low, if the answer is yes, then the routine goes to decision block 60 and, if fewer than five tests were completed, on to decision block 70 terminating the test. This is indicative of proper functioning with capacitor C4 charging within the design parameters. If the answer of decision block 54 is no, then the routine goes to decision block 56 to determine whether 12 ms has elapsed and, if not, it cycles back to decision block 54 until either the flame sense line turns low or the 12 ms period expires. If the period expires without the flame sense line going low, then the flame circuit failure counter is incremented at step 58. The routine then moves to decision block 60 to determine whether the test of decision block 54 has been completed five times. If the answer is yes, then decision block 62 determines whether four out of five have failed the test, i.e., the flame sense line has not gone low. This serves to obviate sporadic noise which could cause a false indication. If four out of five tests have not failed, then step 64 clears the flame test failure flag. Step 66 resets the flame circuit failure counter after which the flame circuit test pin is turned off at step 70 to end the routine. Going back to block 60, if five tests were completed, then the routine goes directly to termination step 70. At decision block 62 if four out of five tests failed, then a flame test failure flag is set at step 72. This serves to notify the main routine that there is a malfunction and appropriate action is taken, such as turning the gas valve off. The routine then goes to step 66 resetting the flame circuit failure counter.

As stated above, in the event that the diagnostic test determines that there is an unacceptable degree of leakage current the microprocessor can be programmed to provide appropriate action such as a selected warning, if desired, or it can shut off the gas valve and maintain energization of the fans to prevent any accumulation of gas.

A diagnostic network and flame detection circuit built in accordance with the invention comprised the following components:

| | | |
|---|---|---|
| R11 | 10K ohms - 5% ⅛ W | U3 - ⅙ of CD 4069 |
| R12 | 5.1 meg ohms - 5% ⅛ W | C3 - 1000 pF 10% 1 KV |
| R13 | 7.5 meg ohms - 5% ⅛ W | C4 - .1 uF 5% 50 V |
| R14 | 1.0 meg ohms - 5% ⅛ W | CR10 - 1N458A |
| | | P1 - Flameprobe |

Figure 4:
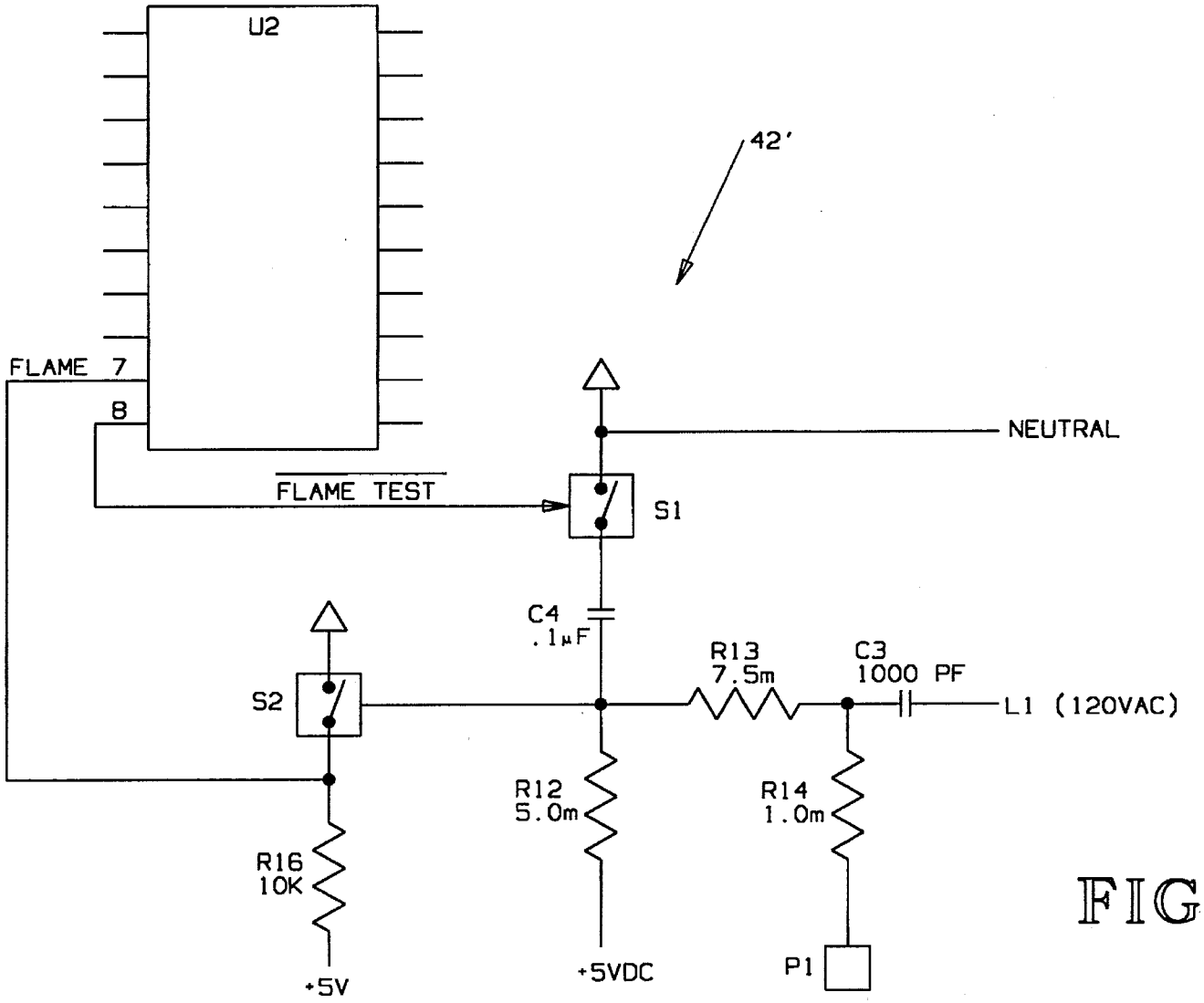
FIG. 4 is a schematic view of another embodiment of the diagnostic network portion.

With respect to FIG. 4, an alternate embodiment of the diagnostic network 42' employs CMOS switches S1 and S2. Switch S1 is coupled between capacitor C4 and ground, or neutral, with its gate connected to flame test pin 8. The other side of capacitor C4 is coupled to a 5 volt DC source through resistor R12. Switch S2 is coupled between a positive 5 volt source to ground through resistor R16 and with its gate connected to flame sense pin 7. At power up microprocessor U2 opens switch S1 effectively removing capacitor C4 from the circuit and eliminating filtering of the L1 signal. If line L1 (AC "hot") and the neutral are properly connected a 60 HZ signal will be applied to the input pin 7 of microprocessor U2 (signal name FLAME). If line L1 and the neutral are reversed, no 60 HZ signal will be applied to the microprocessor. Thus, proper AC line connections can be tested and confirmed.

Once this test has been completed, switch S1 is closed. During a normal attempt for ignition the self-diagnostic feature can be used. In the presence of a flame capacitor C4 will be discharged assuming that switch S1 is closed. Discharge of capacitor C4 will cause switch S2 to close which in turn will cause the FLAME signal to change state. If capacitor C4 is charged, assuming switch S1 is closed, switch S2 is closed causing the FLAME signal to be low indicating the absence of a flame. If capacitor C4 is discharged then the FLAME signal will be high. In other words, if the flame test line is turned low forcing switch S1 to open, then the voltage at the input of switch S2 will go high forcing the FLAME line low. However, if there is a leakage path to ground at that input, whether it is capacitor C4 or switch S1, then that change of state will not occur within a given amount of time which is detected by microprocessor U2 as a fault.

Once ignition has been detected and the flame is stable, switch S1 is opened to simulate a no flame condition. Although the charge on capacitor C4 is not changed, opening switch S1 removes the capacitor's reference to ground and its ability to "see" flame is lost. A 60 HZ signal should appear at pin 7 which the microprocessor will diagnose as a failure of the flame circuit. Assuming the 60 HZ signal appears, microprocessor U2 closes switch S1 when the input (signal FLAME) is high. This is the opposite state of the flame being present. Since ignition has occurred, the microprocessor can measure the amount of time it takes for the input (signal FLAME to go low). If it is not within a given range the filter capacitor C4 can be detected as being faulty, i.e., if the time is too short capacitor C4 is "leaky," if it is too long the flame is lost or the inverter leakage current is too high.

Numerous variations and modifications of the invention will become readily apparent to those familiar with furnace controls. For example, a low leakage transistor could be employed in place of diode CR10 or a low leakage input transistor such as an FET or MOSFET could be used in place of inverter U3 along with a pair of transistors. The invention should not be considered as limited to the specific embodiment depicted, but rather as defined in the claims.

The LST file is set forth below:

What is claimed:

1. Flame detection apparatus for use in a furnace comprising:

a microprocessor having input ports and output ports, an AC voltage power source and a 5 volt DC power supply, a flameprobe having an input lead, a first capacitor having first and second terminals, the first terminal connected to the AC voltage power source, a first resistor having first and second ends, the first end serially connected to the second terminal of the first capacitor, the input lead of the flameprobe connected to a location intermediate the first capacitor and the first end of the first resistor, the second end of the first resistor connected to an input port of the microprocessor through a change of state device having an input and an output, the change of state device changing between first and second states in response to the input of the change of state device, a second capacitor having first and second terminals, the first terminal of the second capacitor connected between the second end of the first resistor and the input of the change of state device, the second terminal of the second capacitor connected to ground, a first charge path for the second capacitor comprising the 5 volt DC power supply connected to a first end of a second resistor having first and second ends, the second end of the second resistor connected to a point between the second end of the first resistor and the input of the change of state device and a second charge path for the second capacitor connected between an output port of the microprocessor and the input of the change of state device, the first charge path being used, in conjunction with the first resistor and the flameprobe, to provide an input to the change of state device controlling the output of the change of state device thereby providing a signal to the microprocessor representative of the presence or absence of a flame, and the second charge path being used during a test procedure initiated by the microprocessor through the second charge path to determine leakage characteristics of the change of state device and the second capacitor.

2. Flame detection apparatus according to claim 1 in which the second charge path comprises a serially connected diode and resistor.

3. Flame detection apparatus according to claim 2 in which the value of the resistance of the resistor in the second charge path is less than the value of resistance of the second resistor.

4. Flame detection apparatus according to claim 1 in which the second charge path comprises a diode having leakage characteristics in the order of 1 nano-amp at 200 volts reversed.

5. Flame detection apparatus according to claim 2 in which the diode has leakage characteristics in the order of 1 nano-amp at 200 volts reversed.

6. Flame detection apparatus according to claim 1 in which the second charge path comprises a 1N458A diode.

7. Flame detection apparatus according to claim 1 in which the change of state device is an inverter.

8. A method for checking the effectiveness of the operation of a flame detection circuit having a change of state device, first and second resistors and a capacitor in which the capacitor, coupled to an input of the change of state device which changes between first and second states in response to changes in the input of the change of state device, is charged through a first charge path connected to the capacitor by a first DC voltage source when no flame is present through the first resistor and discharged through the second resistor and a flame to ground to cause the change of state device to change state from the first state to the second state when there is a flame thereby providing an indication of the presence of a flame, comprising the steps of providing a second charge path connected to the capacitor in which a second DC voltage source is selectively connected to the input of the change of state device through a third resistor having a lower resistance value than the first resistor and applying the second DC voltage source to the capacitor at a time when the change of state device is in the second state indicating the presence of a flame to charge the capacitor and cause the change of state device to change state to the first state and determining a first period of time expended for the change of state device to change state following the application of the second DC voltage source through the second charge path, comparing the first period of time to a standard with the difference in time between the first period of time and the standard reflecting the efficacy of the flame detection circuit.

9. A method according to claim 8 including the steps of interrupting the DC source in the second charge path subsequent to the change of state device changing state to the first state as a result of the application of the second DC voltage source through the second charge path and determining a second period of time expended for the change of state device to change state again to the second state, when a flame is present, comparing the second period of time to a standard with the difference in time between the second period and the standard reflecting the quality of the flame.

10. A method according to claim 8 in which the second charge path includes a diode having leakage characteristics in the order of 1 nano-amp at 200 volts reversed, the anode of the diode connected to an output of a microprocessor which provides the second DC voltage source for the second charge path as well as determines the first period of time and compares the first period of time to the standard.

* * * * *